United States Patent [19]

Ishikawa et al.

[11] Patent Number: 4,781,162

[45] Date of Patent: Nov. 1, 1988

[54] THROTTLE VALVE CONTROL SYSTEM FOR AN INTERNAL COMBUSTION ENGINE

[75] Inventors: Yoshikazu Ishikawa; Kouji Yamaguchi, both of Wako, Japan

[73] Assignee: Honda Giken Kogyo Kabushiki Kaisha, Tokyo, Japan

[21] Appl. No.: 80,924

[22] Filed: Aug. 3, 1987

[30] Foreign Application Priority Data

Aug. 4, 1986 [JP] Japan ..... 61-183850
Aug. 4, 1986 [JP] Japan ..... 61-183852

[51] Int. Cl.[4] ..... F02D 9/08; F02D 41/14
[52] U.S. Cl. ..... 123/399; 123/361
[58] Field of Search ..... 123/339, 349, 352, 361, 123/399

[56] References Cited

U.S. PATENT DOCUMENTS 4,625,690 12/1986 Morita ..... 123/399 X

FOREIGN PATENT DOCUMENTS 192843 10/1985 Japan .

*Primary Examiner*—Tony M. Argenbright
*Attorney, Agent, or Firm*—Pollock, VandeSande & Priddy

[57] ABSTRACT

A throttle valve control system for a vehicle-mounted internal combustion engine, whereby engine operating parameters relating to engine load are detected, and a target value of a first engine operating parameter is established in accordance with an engine rotational speed, for example a target value which will endure minimum fuel consumption. The throttle valve is driven towards a control opening angle which is determined such as to reduce an amount of deviation of an actual value of the first engine operating parameter from the target value, but is held below an upper limit opening angle which is determined in accordance with an engine operating parameter.

8 Claims, 9 Drawing Sheets

THROTTLE VALVE CONTROL SYSTEM FOR AN INTERNAL COMBUSTION ENGINE

BACKGROUND OF THE INVENTION

1. Field of the Invention

The present invention relates to a throttle valve control system for controlling the opening angle of a throttle valve of an internal combustion engine.

2. Description of Background Information

A prior art throttle valve control system is described, for example, in Japanese Laid-open Patent No. 60-192843, which describes an apparatus whereby a throttle valve is driven to an opening angle which is determined in accordance with the operating position of the accelerator and the engine rotational speed, for providing improved engine response. Means have also been envisaged for controlling the throttle valve opening angle such as to reduce the engine fuel consumption, for example by deriving a minimum fuel consumption factor in accordance with the engine rotational speed, setting a target value for the pressure within the intake pipe of the engine (referred to in the following as the induction manifold pressure), and driving the throttle valve such as to reduce the amount of deviation between the actual induction manifold pressure and the target induction manifold pressure. Such a system has been proposed hitherto by the assignees of the present invention.

However with a throttle valve control system whereby the throttle valve is controlled such as to make the actual induction manifold pressure become equal to a target inlet manifold pressure, there is a tendency for the throttle valve to be driven to an excessively high opening angle when the engine is used in a region at a high altitude, i.e. is operated under a lower atmospheric pressure than normal. As a result, if the throttle valve is abruptly controlled such as to move in the closing direction, there will be a substantial amount of control delay. This control delay is introduced as a result of the excessively open condition of the throttle valve. Thus, satisfactory engine operating response may not be obtained.

Furthermore usually with such a throttle valve control system, the more deeply the accelerator pedal is depressed, the greater will be the amount of control which is applied to the throttle valve opening angle. However since the range through which the throttle valve can be driven by such control extends from a condition of being fully closed to that of being fully opened, a large degree of control overshoot can occur when the throttle valve is driven in accordance with the amount of deviation between a detected value and a target value. An excessive amount of throttle valve opening can thereby result, which produces a delay in response to such control and can cause fluctuations in the engine output power. Satisfactory engine operation may therefore not be attainable.

SUMMARY OF THE INVENTION

It is a first objective of the present invention to provide a throttle valve control system for an internal combustion engine whereby satisfactory engine operation can be assured at all times.

It is a further objective of the present invention to provide a throttle valve control system for an internal combustion engine whereby satisfactory engine operation can be reliably attained when the engine is operated in regions at high altitudes.

It is a further objective of the present invention to provide a throttle valve control system for an internal combustion engine whereby satisfactory engine operation can be reliably attained when the accelerator pedal is depressed by a substantial amount.

In order to achieve the objectives set out above, a throttle valve control system according to the present invention comprises setting means for setting a target value of a first engine operating parameter, drive means for driving the throttle valve in accordance with a detected value of the first engine operating parameter such as to reduce a deviation between this detected value and the target value, with the drive means also functioning to set an upper limit value of the throttle valve opening angle in accordance with a second engine operating parameter which is different from the first engine operating parameter and to control the throttle valve opening angle to be held below this upper limit value.

DETAILED DESCRIPTION OF EMBODIMENTS

The preferred embodiment of the present invention will be described with reference to the accompanying drawings.

Figure 1:
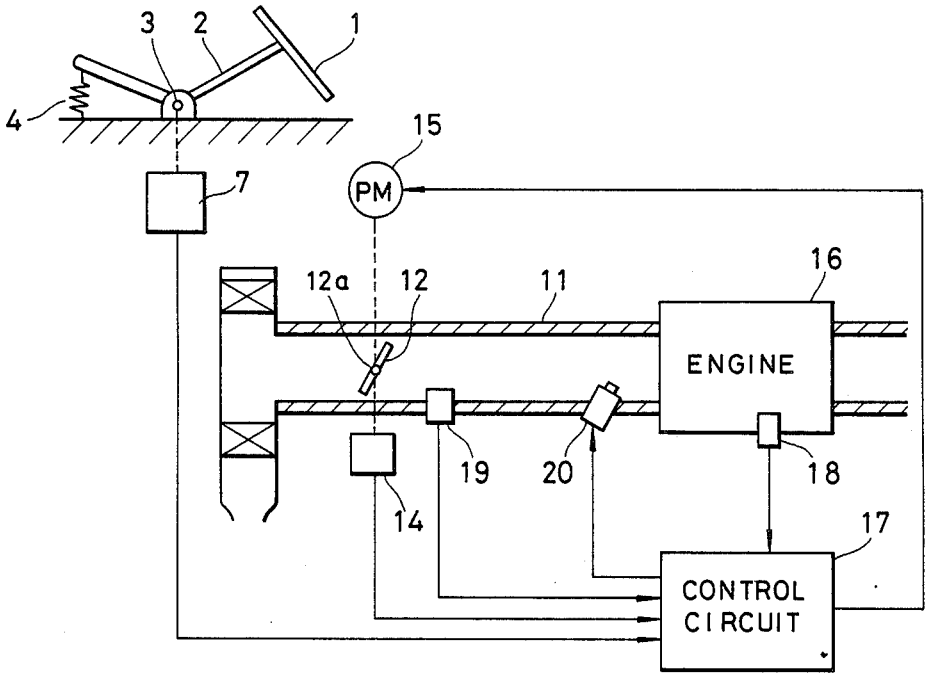
FIG. 1 is a schematic diagram of the general configuration of embodiments of the present invention.

A throttle valve control system mounted in a motor vehicle is shown in FIG. 1 as the preferred embodiment of the present invention. An accelerator pedal 1 is coupled to one end of an angle bracket 2 which is mounted by a shaft 3 such as to permit swinging movement of the accelerator pedal with respect to the floor of a vehicle. A return spring 4 is coupled to the other end of bracket 2, and urges the accelerator pedal 1 upwards to an idling position. An accelerator operating position sensor 7 consisting of a potentiometer is coupled to the shaft 3, and produces an output voltage in accordance with the operating position of the accelerator pedal 1, i.e. in accordance with the accelerator pedal angle. This angle is defined as the angle through which the shaft 3 has rotated about the axis thereof, from the idling position of the accelerator pedal 1.

A throttle valve opening sensor 14 similarly consists of a potentiometer which is coupled to a shaft 12a of throttle valve 12, mounted in the engine intake pipe 11, and generates an output voltage in accordance with the degree of opening of throttle valve 12. The shaft 12a of throttle valve 12 is also coupled to the drive shaft of a pulse motor 15.

The accelerator operating position sensor 7, the throttle valve opening sensor 14 and the pulse motor 15 are connected to a control circuit 17. Also coupled to the control circuit 17 are a crank angle sensor 18 for generating a pulse each time the crankshaft of the engine (not shown in the drawings) reaches a predetermined angular position during rotation of the crankshaft, an absolute pressure sensor 19 for generating an output signal which represents an absolute induction manifold pressure, and an injector 20 which injects fuel into engine cylinders of engine 16.

Figure 2:
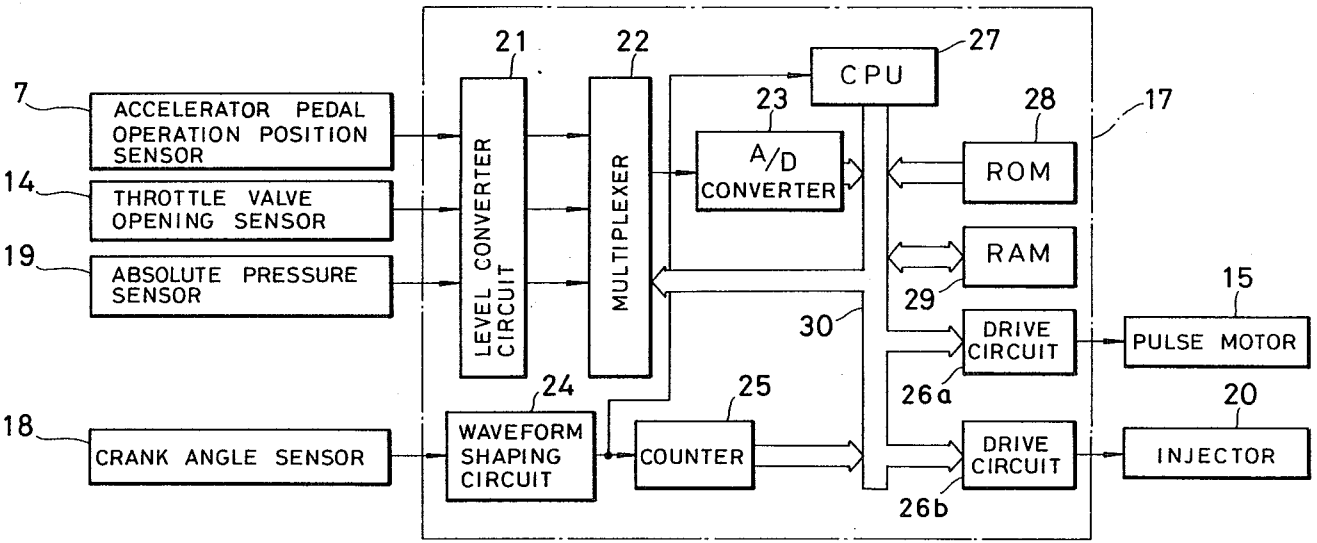
FIG. 2 is a block diagram of a specific configuration for a control circuit in the system of FIG. 1.

As shown in FIG. 2, the control circuit 17 contains a level converter circuit 21 which performs level conversion of the respective output signals from the accelerator pedal operating position sensor 7, the throttle valve opening sensor 14, and the absolute pressure sensor 19. The control circuit 17 also includes a multiplexer 22 which receives the levelconverted output voltage signals from level converter circuit 21 and selects one of these output signals to be produced as output, an A/D converter 23 which performs analog-digital conversion of the selected output voltage from multiplexer 22, a waveform shaping circuit 24 for performing waveform shaping of the output signal from the crank angle sensor 18, a counter 25 for measuring the intervals between generation of successive TDC (top dead-center) signals which are produced as pulse signals by the waveform shaping circuit 24, by counting clock pulses supplied from a clock pulse generating circuit (not shown), a drive circuit 26a which drives the pulse motor 15, a drive circuit 26b for driving the injector 20, a CPU (Central Processing Unit) 27 which performs digital operations in accordance with programs, a ROM (Readonly Memory) 28 in which programs and data are stored prior to operation of the engine, and a RAM (Random Access Memory) 29. The multiplexer 22, the A/D converter 23, the counter 25, the drive circuits 26a and 26b, the CPU 27, the ROM 28 and the RAM 29 are mutually interconnected by a bus 30. Although not shown in the drawings, the CPU 27 also receives clock pulses from a clock pulse generating circuit. The CPU 27 functions as target value setting means, and the CPU 27 and the drive circuit 26a function in combination as throttle valve drive means.

Respective data for the accelerator pedal angle $\theta_{ACC}$, the throttle valve opening angle $\theta_{th}$, and the absolute induction manifold pressure $P_{BA}$, selectively transferred by from the A/D converter 23, together with data representing the engine rotational speed $N_e$, are supplied to the CPU 27 through the bus 30. The CPU 27 executes read-in of the respective data in accordance with a processing program which is stored in ROM 28, in synchronism with the clock pulses. CPU 27 also performs processing as described hereinafter for generating pulse motor valve opening drive commands, pulse motor valve closing drive commands, and pulse motor drive halt commands (to halt operation of the pulse motor) which are supplied to the drive circuit 26a to drive the pulse motor 15.

Figure 3:
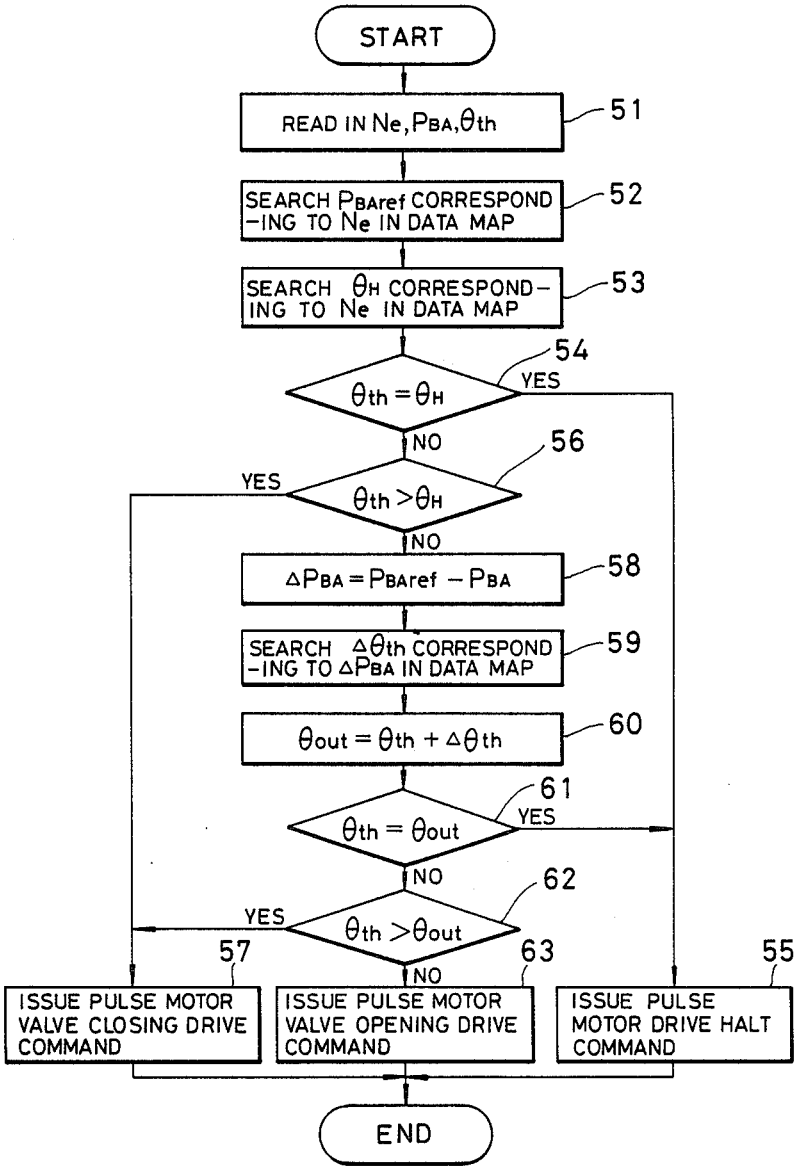
FIG. 3 is a flow chart for describing the operation of CPU 27 in a first embodiment of the present invention.

The operation of a throttle valve control system according to a first embodiment of the present invention will now be described with reference to the operating flow of CPU 27 which is shown in FIG. 3.

Figure 4:
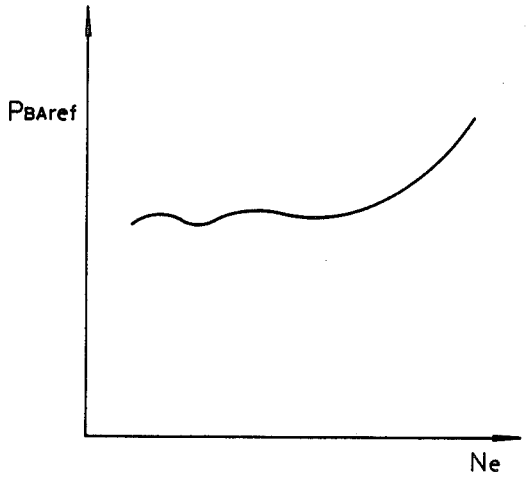
FIG. 4 is a diagram showing a characteristic of a $P_{BAref}$ data map which is stored in a ROM 28 prior to engine operation.
Figure 5:
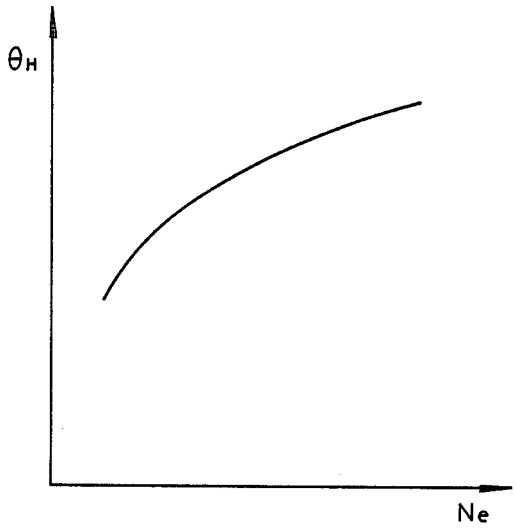
FIG. 5 is a diagram showing a relationship between engine rotational speed $N_e$ and throttle valve upper limit opening angle $\theta_H$ which is stored in ROM 28 prior to engine operation.
Figure 6:
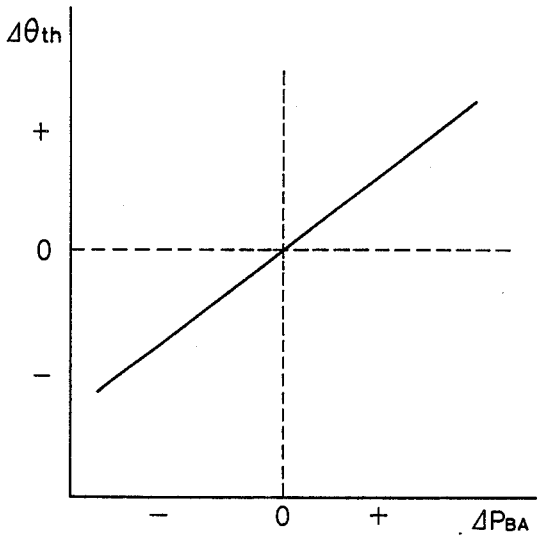
FIG. 6 shows the characteristic of a $\Delta\theta_{th}$ data map which is stored in ROM 28 prior to engine operation.

At predetermined periodic intervals, the CPU 27 executes read-in of the engine rotational speed $N_e$, the absolute induction manifold pressure $P_{BA}$, and the throttle valve opening angle $\theta_{th}$ (step 51), and searches for a target absolute induction manifold pressure $P_{BAref}$ in accordance with the engine rotational speed $N_e$ which has been read in (step 52). In addition, an upper limit opening angle $\theta_H$ is searched for, based upon the engine rotational speed $N_e$ which has been read in (step 53). A $P_{BAref}$ data map of values of target absolute induction manifold pressure which provide a minimum fuel consumption coefficient, for respective values of engine rotational speed Ne, is stored in ROM 28, and has the characteristic shown in FIG. 4. A $\theta_H$ data map, of values of throttle valve upper limit opening angle $\theta_H$ with respect to engine rotational speed $N_e$ is also stored in ROM 28, having the characteristic shown in FIG. 5. In this way, a target absolute induction manifold pressure $P_{BAref}$ can be searched for in the $P_{BAref}$ data map, in accordance with the engine rotational speed $N_e$ which has been read in, while the upper limit opening angle $\theta_H$ can be searched for in the $\theta_H$ data map in accordance with engine rotational speed $N_e$. A decision is made as to whether or not the throttle valve opening angle $\theta_{th}$ which has been read in is equal to the upper limit opening angle $\theta_H$ (step 54). If $\theta_{th}=\theta_H$, then a pulse motor drive halt command is issued (step 55). If $\theta_{th}\neq\theta_H$, then a decision is made as to whether or not the throttle valve opening angle $\theta_{th}$ which has been read in is greater than the upper limit opening angle $\theta_H$ (step 56). If $\theta_{th}>\theta_H$, then a pulse motor valve closing drive command is issued to the drive circuit 26a, to drive the throttle valve 12 in the closing direction (step 57). If $\theta_{th}<\theta_H$, then the deviation $\Delta P_{BA}$ between the target absolute induction manifold pressure $P_{BAref}$ and the absolute induction manifold pressure $P_{BA}$ which has been read in is computed (step 58). An opening angle correction quantity $\Delta\theta_{th}$ of throttle valve 12 is then searched for in a data map of $\Delta\theta_{th}$ with respect to manifold pressure deviation $\Delta P_{BA}$ which is stored beforehand in ROM 28 and has the characteristic shown in FIG. 6 (step 59). The opening angle correction quantity $\Delta\theta_{th}$ which is thus obtained is added to the throttle valve opening angle $\theta_{th}$ which was read in, to thereby compute a control opening angle $\theta_{OUT}$ (step 60). A decision is then made as to whether or not the opening angle $\theta_{th}$ which was read in is equal to the control opening angle $\theta_{OUT}$ (step 61). If $\theta_{th}=\theta_{OUT}$, then a pulse motor drive halt command is generated and issued to the drive circuit 26a (step 55). If $\theta_{th}\theta_{OUT}$, then a decision is made as to whether or not $\theta_{th}$ is greater than $\theta_{OUT}$ (step 62). If $\theta_{th}>\theta_{OUT}$, then since this indicates that the throttle valve opening angle is excessively large with respect to the engine rotational speed, a pulse motor valve-closing drive command is issued to drive circuit 26a, whereby the throttle valve is driven in the closing direction (step 57). If $\theta$ is not found to be greater than $\theta_{OUT}$ in step 62, and hence is less than $\theta_{OUT}$, then a pulse motor valve-opening drive command is issued to drive circuit 26a, whereby the throttle valve is driven in the opening direction (step 63).

The drive circuit 26a responds to a pulse motor valve-opening drive command by executing rotation by pulse motor 15 in the forward direction to thereby drive the throttle valve 12 towards the valve opening condition, and responds to a pulse motor valve-closing drive command by executing rotation by pulse motor 15 in the reverse direction to thereby drive the throttle valve 12 towards the closed condition. Drive circuit 26a moreover responds to a pulse motor drive halt command by halting the rotation of pulse motor 15, to thereby maintain the current degree of throttle valve opening. In this way the throttle valve opening angle $\theta$is controlled such as to follow the control opening angle $\theta_{OUT}$. In addition, if the control opening angle $\theta_{OUT}$ should exceed the upper limit opening angle $\theta_H$, control is executed such that the throttle valve opening angle $\theta_{th}$ is held below this upper limit $\theta_H$.

Figure 7:
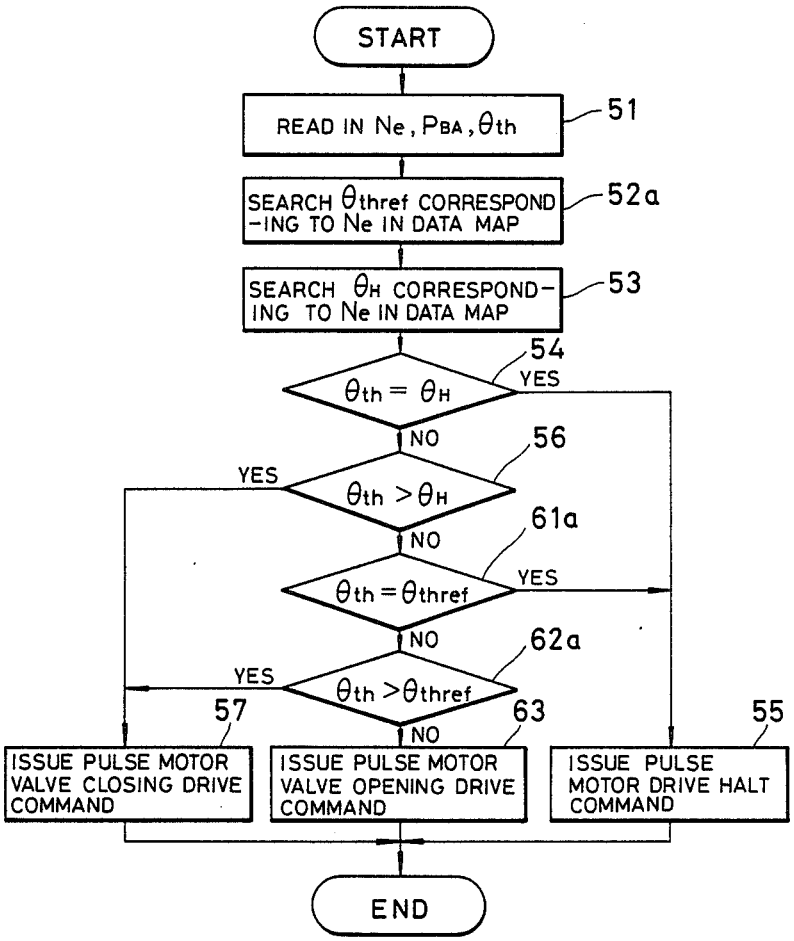
FIG. 7 is a flow chart of the operation of CPU 27 for a second embodiment of the present invention.

With the first embodiment of the present invention described above, if $\theta_{th}$ is less than $\theta_H$, the system operates such as to reduce the deviation between the target absolute induction manifold pressure (which provides minimum fuel consumption at the current speed of engine rotation) and the actual value of absolute induction manifold pressure. A second embodiment of a throttle valve control system according to the present invention will now be described, with reference to the flow chart of FIG. 7. With the second embodiment, a target opening angle $\theta_{thref}$ which provides minimum fuel consumption at the current engine rotation speed is obtained by searching a data map that has been previously stored (step 52a). If $\theta_{th}<\theta_H$, then a decision is made as to whether or not $\theta$this equal to $\theta_{thref}$(step 61a). If they are not found to be equal, then a decision is made as to whether or not the throttle valve opening angle $\theta_{th}$ is greater than $\theta_{thref}$ (step 62a).

It should be noted that it would be equally possible to arrange that if the control opening angle $\theta_{OUT}$(obtained by computation in step 60) is greater than the upper limit opening angle $\theta_H$, then the throttle valve is driven to an angle of opening which is equal to the upper limit opening angle $\theta_H$.

Thus as described above, with a throttle valve control system for an internal combustion engine according to the first or second embodiment of the present invention, a throttle valve is controlled such as to be held below an upper limit opening angle which is determined in accordance with the engine rotational speed. As a result, when the engine is operated in a region at high altitude, excessive opening of the throttle valve is prevented. In this way, if the throttle valve is actuated such as to be rapidly moved in the opening direction, the throttle valve control system acts to prevent any unnecessary delay before the engine attains the required output power level. Enhanced operating response is thereby obtained.

A third embodiment of the present invention will now be described, referring to the flow chart of FIG. 8.

Figure 8:
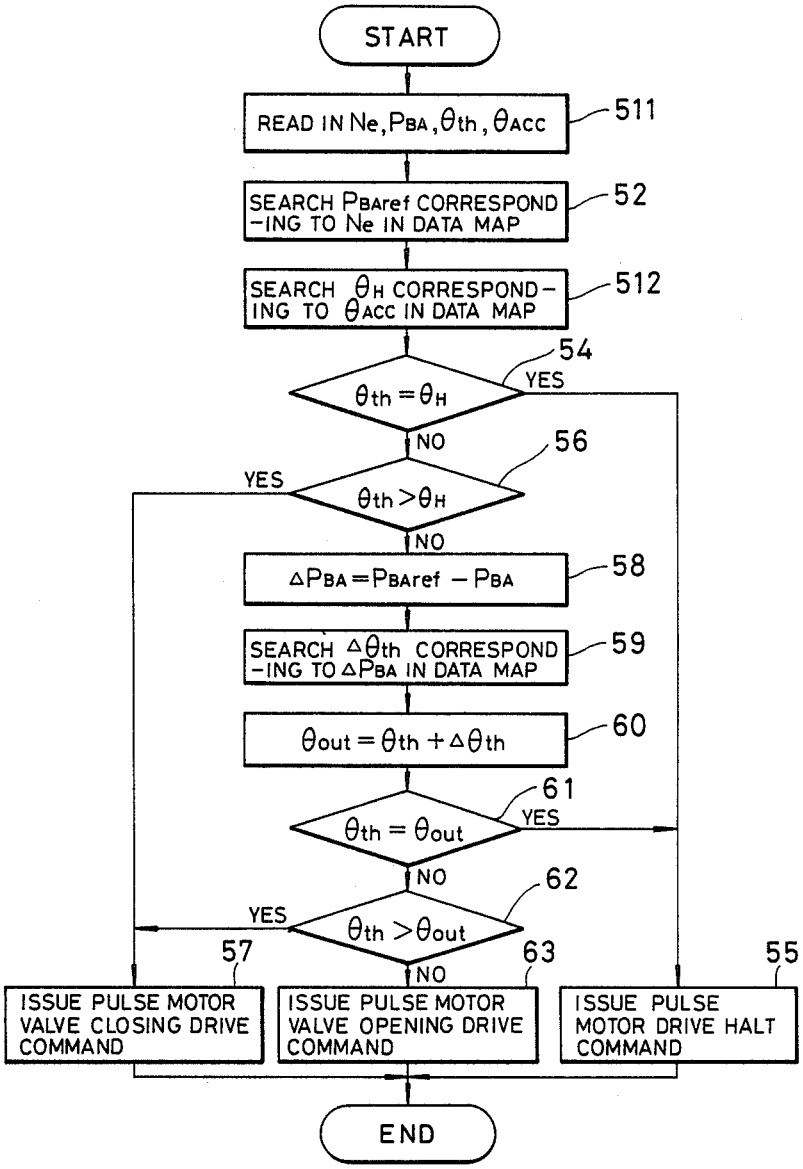
FIG. 8 is a flow chart of the operation of CPU 27 for a third embodiment of the present invention.
Figure 9:
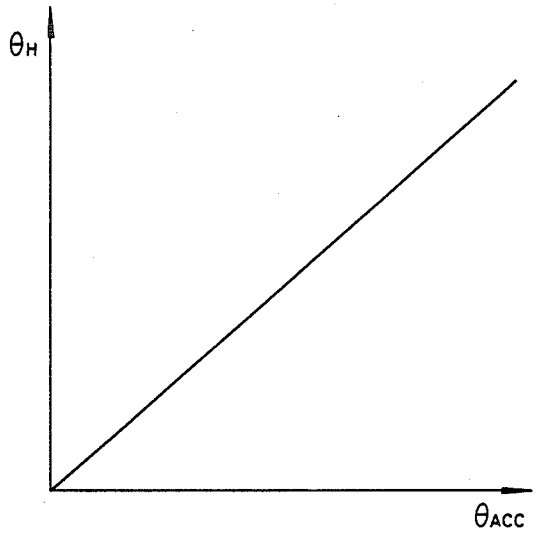
FIG. 9 is a diagram showing a characteristic of a relationship between accelerator pedal angle $\theta_{ACC}$ and throttle valve upper limit opening angle $\theta_H$.

In FIG. 8, the CPU 27 executes read-in of the engine rotational speed $N_e$, the absolute induction manifold pressure $P_{BA}$, the throttle valve opening angle $\theta_{th}$, and the accelerator pedal angle $\theta_{ACC}$, at predetermined periodic intervals (step 511), and searches for a target absolute induction manifold pressure $P_{BAref}$ in accordance with the engine rotational speed $N_e$ which has been read in (step 52). In addition, an upper limit opening angle $\theta_H$ is searched for, based upon the accelerator pedal angle $\theta_{ACC}$ which has been read in (step 512). A $P_{BAref}$ data map of values of target absolute induction manifold pressure which provide a minimum fuel consumption coefficient, for respective values of engine rotational speed $N_e$, is stored beforehand in ROM 28, and has the characteristic shown in FIG. 4. A $\theta_H$ data map, of values of throttle valve upper limit opening angle $\theta_H$ with respect to accelerator pedal angle $\theta_{ACC}$ is also stored in ROM 28, having the characteristic shown in FIG. 9. In steps 52 and 512 respectively, the target absolute induction manifold pressure $P_{BAref}$ is searched for in the $P_{BAref}$ data map, in accordance with the engine rotational speed $N_e$ which has been read in, while the upper limit opening angle $\theta_H$ is searched for in the $\theta_H$data map in accordance with the accelerator pedal angle $\theta_{ACC}$ which has been read in. A decision is made as to whether or not the throttle valve opening angle $\theta_{th}$which has been read in is equal to the upper limit opening angle $\theta_H$ (step 54). If $\theta_{th}=\theta_H$, then a pulse motor drive halt command is issued (step 55). If $\theta_{th}\neq\theta_H$, then a decision is made as to whether or not the throttle valve opening angle $\theta_{th}$ which has been read in is greater than the upper limit opening angle $\theta_H$(step 56). If $\theta_{th}>\theta_H$, then since this indicates that the throttle valve opening angle is excessively large, with regard to the engine rotational speed, a pulse motor valve closing drive command is issued to the drive circuit 26a , to drive the throttle valve 12 in the closing direction (step 57). If $\theta_{th}<\theta_H$, then the deviation $\Delta P_{BA}$ between the target absolute induction manifold pressure $P_{BAref}$ and the absolute induction manifold pressure $P_{BA}$ which has been read in is computed (step 58), and an opening angle correction quantity $\Delta\theta_{th}$ of throttle valve 12 is then obtained by searching a $\Delta\theta$data map which is stored beforehand in ROM 28 and has the characteristic shown in FIG. 6 (step 59). The opening angle correction quantity $\Delta\theta_{th}$ which is thus obtained is added to the throttle valve opening angle $\theta$which was read in, to thereby compute a control opening angle $\theta_{OUT}$ (step 60). A decision is then made as to whether or not the opening angle $\theta_{th}$ which was read in is equal to the control opening angle $\theta_{OUT}$ (step 61). If $\theta_{th}=\theta_{OUT}$, then a pulse motor drive halt command is generated and issued to the drive circuit 26a (step 55). If $\theta_{th}\neq\theta_{OUT}$ , then a decision is made as to whether or not $\theta_{th}$ is greater than $\theta_{OUT}$ (step 62). If $\theta_{th}>\theta_{OUT}$, then a pulse motor valve-closing drive command is issued to drive circuit 26a , whereby the throttle valve is driven in the closing direction (step 57). If $\theta_{th}$ is not found to be greater than $\theta_{OUT}$in step 62, and hence is less than $\theta_{OUT}$, then a pulse motor valve-opening drive command is issued to drive circuit 26a, whereby the throttle valve is driven in the opening direction (step 63).

The drive circuit 26a responds to a pulse motor valve-opening drive command by executing rotation by pulse motor 15 in the forward direction to thereby drive the throttle valve 12 towards the valve opening condition, and responds to a pulse motor valve-closing drive command by executing rotation by pulse motor 15 in the reverse direction to thereby drive the throttle valve 12 towards the closed condition. Drive circuit 26a moreover responds to a pulse motor drive halt command by halting the rotation of pulse motor 15, to thereby maintain the current degree of throttle valve opening. In this way the throttle valve opening angle $\theta_{th}$ is controlled such as to follow the control opening angle $\theta_{OUT}$. In addition, if the control opening angle $\theta_{OUT}$ should exceed the upper limit opening angle $\theta_H$, control is executed such that the throttle valve opening angle $\theta_{th}$ is held below this upper limit $\theta_H$.

Figure 10:
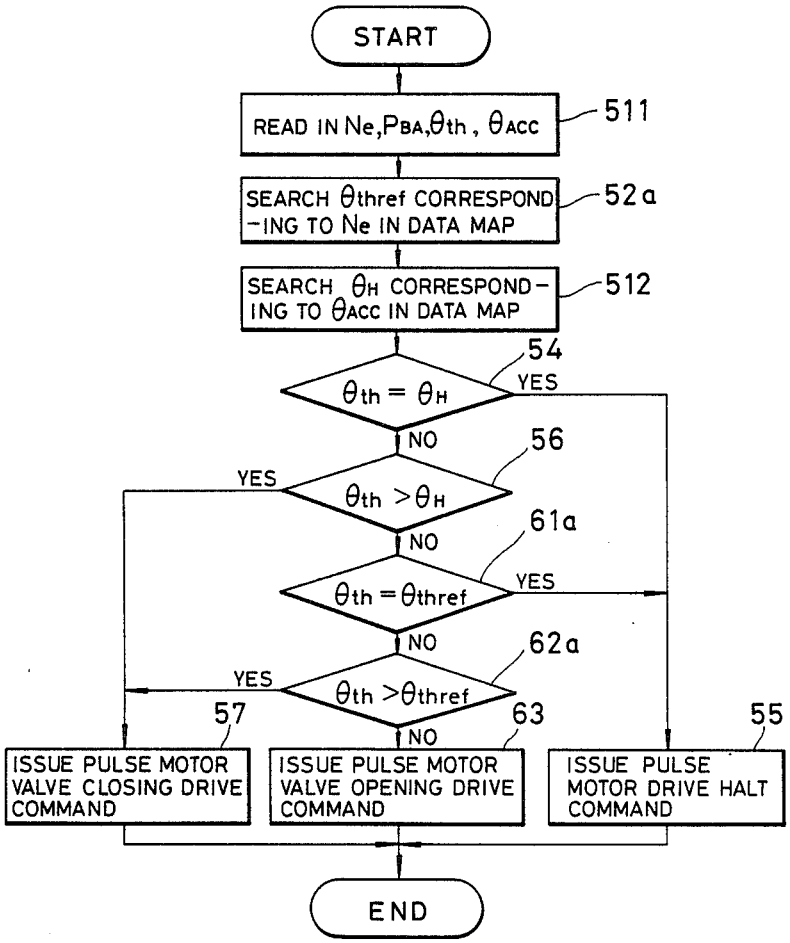
FIG. 10 is a flow chart of the operation of CPU 27 for a fourth embodiment of the present invention.

With the third embodiment of the present invention described above, if $\theta_{th}$ is less than $\theta_H$, the system operates such as to reduce the deviation between the target absolute induction manifold pressure (which provides minimum fuel consumption at the current speed of engine rotation) and the actual value of absolute induction manifold pressure. A fourth embodiment of a throttle valve control system according to the present invention will now be described, with reference to the flow chart of FIG. 10. With the fourth embodiment, a target opening angle $\theta_{thref}$ which provides minimum fuel consumption at the current engine rotation speed is obtained by searching a data map that has been previously stored (step 52*a*). If $\theta_{th} < {}_H$, then a decision is made as to whether or not $\theta_{th}$ is equal to $\theta_{thref}$ (step 61*a*). If they are not found to be equal, then a decision is made as to whether or not the throttle valve opening angle $\theta_{th}$ is greater than $\theta_{thref}$ (step 62*a*), and control of the pulse motor is executed in accordance with the result of the decisions made in steps 61*a* and 62*a*. It should be noted that it would be equally possible to arrange that if the control opening angle $\theta_{OUT}$ (computed in step 60) is greater than the upper limit opening angle $\theta_H$, then the throttle valve is driven to an angle of opening which is equal to the upper limit opening angle $\theta_H$ without detecting whether the actual throttle valve opening angle $\theta_{th}$ is greater than the upper limit opening angle.

Furthermore, although in the third and fourth embodiments of the present invention described above the throttle valve 12 is directly driven by a pulse motor 15, the present invention is equally applicable to an apparatus whereby the operation of the throttle valve is linked to actuation of the accelerator pedal, and whereby a stopper is used to limit the degree of opening of the throttle valve, with the position of the stopper being varied by drive applied from a motor, e.g. a pulse motor.

With the third and fourth embodiments of the present invention for an internal combustion engine according to the present invention as described hereinabove, since the throttle valve is driven such that the opening angle is held below an upper limit opening angle, which is determined in accordance with the operating position of the accelerator pedal, overshoot resulting from excessive opening of the throttle valve is prevented. Thus, fluctuations in the engine output power can be prevented, and enhanced engine response can be attained.

With each of the first through fourth embodiments of the present invention described hereinabove, an opening angle correction quantity $\Delta\theta_{th}$ is obtained by using a $\Delta\theta_{th}$ data map. However it would be equally possible to obtain this opening angle correction quantity by executing the computation $\Delta\theta_{th} = k_l \cdot \Delta P_{BA}$, or $\Delta\theta_{th} = k_2 \cdot N_e \cdot \Delta P_{BA}$ (where $k_1$ and $k_2$ are constants.)

Moreover with the respective embodiments of the present invention described above, when a pulse motor valve opening drive command or a pulse motor valve closing drive command is issued from CPU 27, the drive circuit 26*a* responds by generating pulses to be supplied to the pulse motor 15 which are produced at a fixed frequency. However it would be equally possible to arrange that the CPU 27 issues to the drive circuit 26*a* a pulse motor valve opening drive command or a pulse motor valve closing drive command which expresses a number of pulses corresponding to the difference between the actual throttle valve opening angle $\theta_{th}$ and the control opening angle $\theta_{OUT}$, or the difference between $\theta_{th}$ and the upper limit opening angle $\theta_H$. In this case, the drive circuit 26*a* will supply only the designated number of drive pulses to pulse motor 15.

Furthermore it should be noted that a throttle valve control system according to the present invention is applicable to use together with a CVT (automatic transmission) system, etc, which controls the engine rotational speed in accordance with the accelerator pedal operating position.

What is claimed is:

1. A throttle valve control system for controlling an opening angle of a throttle valve disposed in an intake system of an internal combustion engine which is mounted in a vehicle, the control being executed in accordance with engine operating parameters, comprising:

detecting means for detecting a first engine operating parameter;

setting means for setting a target value of said first engine operating parameter and;

drive means for driving said throttle valve such as to reduce a deviation between said detected value of said first engine operating parameter and said target value;

said drive means further acting to set an upper limit opening angle of said throttle valve in accordance with a second engine operating parameter which is different from said first engine operating parameter, and to limit said throttle valve opening angle to a value which is lower than said upper limit opening angle.

2. A throttle valve control system according to claim 1, in which said first engine operating parameter is an induction manifold pressure, measured at a point in said intake system which is downstream of said throttle valve.

3. A throttle valve control system according to claim 1, in which said first engine operating parameter is an opening angle of said throttle valve.

4. A throttle valve control system according to claim 1, in which said second engine operating parameter is an engine rotational speed of said internal combustion engine.

5. A throttle valve control system according to claim 1, in which said second engine operating parameter is an accelerator pedal angle which expresses an operating position of said accelerator pedal.

6. A throttle valve control system according to claim 1, in which said setting means sets a target value of said first engine operating parameter in accordance with a third engine operating parameter.

7. A throttle valve control system according to claim 6, in which said third engine operating parameter is an engine rotational speed of said internal combustion engine.

8. A throttle valve control system according to claim 7, in which said setting means sets said target value of said first engine operating parameter so as to obtain a minimum fuel consumption.

* * * * *